United States Patent [19]

Miller et al.

[11] Patent Number: 4,580,613

[45] Date of Patent: Apr. 8, 1986

[54] METHOD AND MOLD FOR CASTING ARTICLES HAVING A PREDETERMINED CRYSTALLINE ORIENTATION

[75] Inventors: Evan R. Miller, Flanders; Lamar Burd, Andover; Eugene J. Carozza, Succasunna, all of N.J.; Robert E. Grunstra, North Muskegon, Mich.

[73] Assignee: Howmet Turbine Components Corporation, Greenwich, Conn.

[21] Appl. No.: 405,588

[22] Filed: Aug. 5, 1982

[51] Int. Cl.[4] ..... B22C 9/04

[52] U.S. Cl. ..... 164/35; 164/122.2; 164/361

[58] Field of Search ..... 164/122.1, 122.2, 125, 164/127, 361, 34, 35

[56] References Cited

U.S. PATENT DOCUMENTS

| | | | |
|---|---|---|---|
| 1,793,672 | 2/1931 | Bridgman | 164/122.2 X |
| 2,970,075 | 1/1961 | Grenoble | 164/122.1 X |
| 3,060,065 | 10/1962 | Orem | 156/608 |
| 3,248,764 | 5/1966 | Chandley | 164/127 |
| 3,260,505 | 7/1966 | Ver Snyder | 164/122.1 X |
| 3,494,709 | 2/1970 | Piearcey | 416/232 |
| 3,568,757 | 3/1971 | Piearcey | 164/122.2 X |
| 3,580,324 | 5/1971 | Copley et al. | 164/122.2 |
| 3,724,531 | 4/1973 | Erickson et al. | 164/361 |
| 4,015,657 | 4/1977 | Petrov et al. | 164/361 |

FOREIGN PATENT DOCUMENTS

| | | | |
|---|---|---|---|
| 59549 | 9/1982 | European Pat. Off. | 164/122.1 |
| 2030233A | 4/1980 | United Kingdom | 164/122.2 |
| 2037200A | 7/1980 | United Kingdom | 164/122.2 |

*Primary Examiner*—Nicholas P. Godici
*Assistant Examiner*—J. Reed Batten, Jr.
*Attorney, Agent, or Firm*—McDougall, Hersh & Scott

[57] ABSTRACT

A mold construction and method for use in producing articles having a predetermined crystalline orientation including single crystals. The technique employs a seed holder or cradle that is inserted into a bottom aperture of a ceramic mold to permit the precise orientation of one or more seeds relative to the article cavity and to provide improved solidification process control. The technique also facilitates pattern assembly and pattern removal operations during fabrication of the ceramic mold.

52 Claims, 15 Drawing Figures

FIG. 1
PRIOR ART
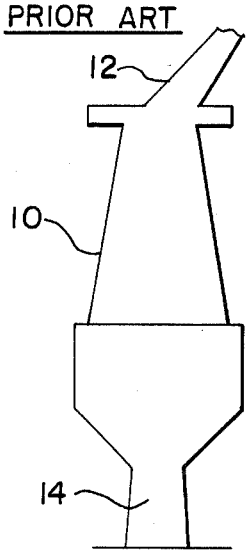
FIG. 2
PRIOR ART
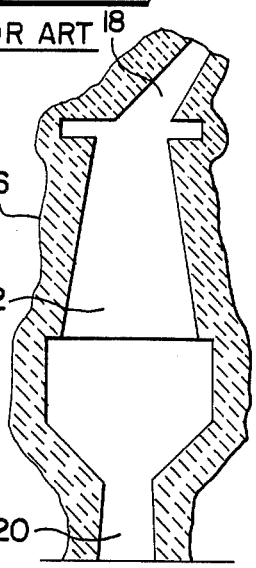
FIG. 12
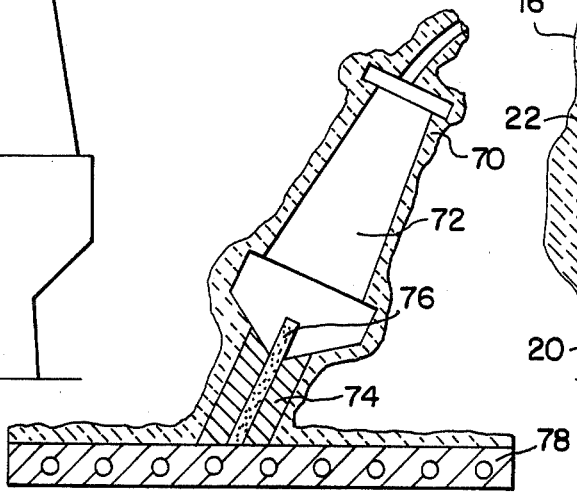
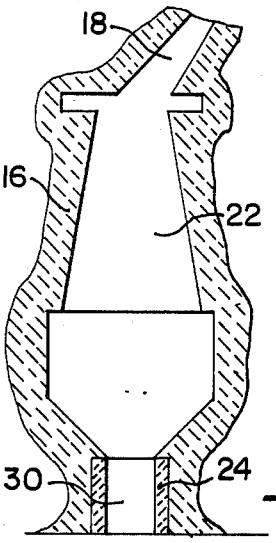
FIG. 4
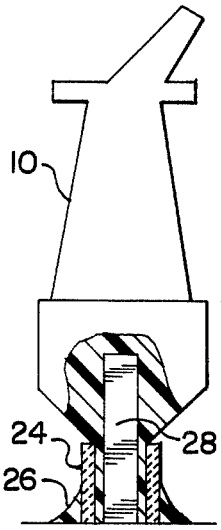
FIG. 3
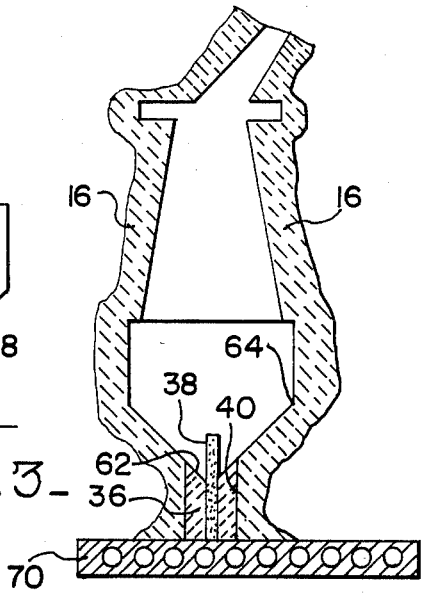
FIG. 5

FIG. 6A
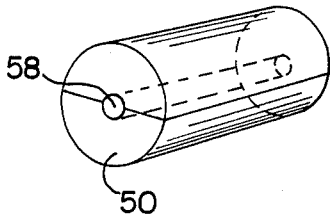
FIG. 6B
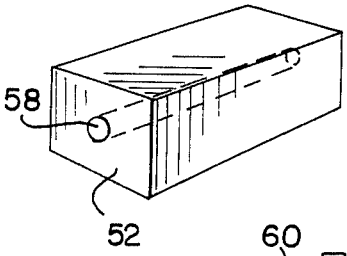
FIG. 6C
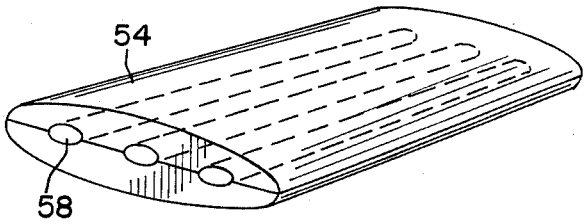
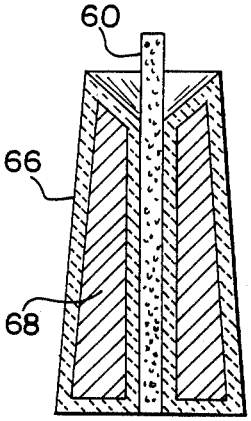
FIG. 8
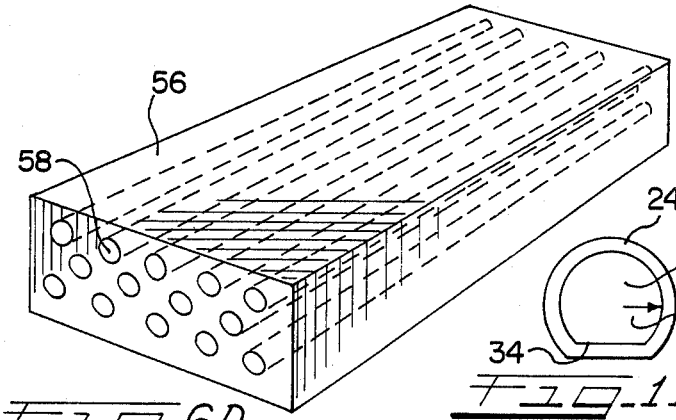
FIG. 6D
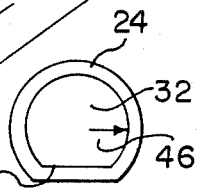
FIG. 11
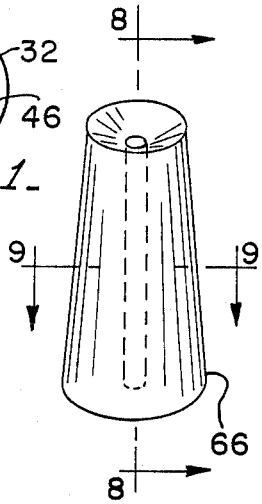
FIG. 7
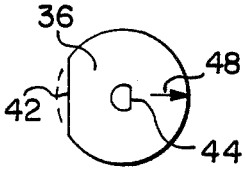
FIG. 10
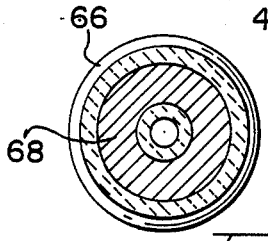
FIG. 9

METHOD AND MOLD FOR CASTING ARTICLES HAVING A PREDETERMINED CRYSTALLINE ORIENTATION

BACKGROUND OF THE INVENTION

Cast single crystal articles such as turbine blades and vanes can be produced by several techniques. A common method involves the use of a starter zone at the bottom of the mold wherein a plurality of columnar grains are formed. A "nonlinear" or transversely displaced crystal selector (e.g., a helix-shaped passage) connects the starter zone to the article cavity, and this selector insures that only one columnar grain grows into the article cavity. Single crystal castings also can be produced using molds which have a vertical "slender projection" at the bottom of the article cavity (i.e., a linear or non-transversely displaced "neck") as described in Bridgman U.S. Pat. No. 1,793,672.

When traditional directionally solidified (columnar-grained polycrystalline) articles are desired, the starter zone communicates directly with the article cavity (no crystal selector is present) as described in Chandley U.S. Pat. No. 3,248,764, VerSnyder U.S. Pat. No. 3,260,505, and Piearcey U.S. Pat. No. 3,494,709.

These techniques generally are restricted to producing articles that have the "natural" crystal growth directional (e.g., the <001> direction in face-centered cubic and body centered cubic metals) oriented along the "longitudinal" dimension of the article. This longitudinal dimension generally is normal to the chill plate and/or parallel with the direction of heat withdrawal. In addition, with these methods of making a single crystal, it can be difficult or impossible to simultaneously align the secondary orientation of the grain relative to a desired "transverse" dimension of the article i.e., to orient an orthogonal <010> or <100> direction within the article cavity).

These limitations can be avoided by using seed crystals as described in the aforementioned Bridgman patent. Briefly stated, one of Bridgman's methods involves use of a mold with a cavity that terminates with a vertical passageway, the end of which constitutes a mold aperture. Seed crystals of any desired primary and/or secondary orientation are inserted into the aperture, liquid metal is formed in (or preferably poured into) the mold, and solidification proceeds by epitaxial growth from the seed (in the presence of a longitudinal temperature gradient) using practices which avoid the nucleation of new grains.

It is well known to those skilled in the art that effective use of the Bridgman seeding methods requires that the size and shape of the mold aperture closely approximate the cross section of the seed crystal, both to preclude metal running past the seed and out of the mold, and to avoid the nucleation of new grains in interstices between the mold and the seed. In addition, it also is well known that it is generally desirable for both technical and economic reasons to use seeds of relatively small crosssectional area. These considerations can restrict the utility of the Bridgman seeding method in the following ways:

(1) It can be difficult or impossible to accommodate individual deviations in the longitudinal crystallographic orientation of seeds relative to their external envelopes since they must mate with a fixed mold aperture.

(2) It can be awkward to position small diameter seeds (e.g., 0.030") in the proper secondary orientation, as a result of ordinary handling and manipulation problems.

(3) When ceramic molding techniques are utilized, as is preferred in the production of directionally solidified turbine blades and vanes, the dimensional reproducibility limitations of current ceramic molding methods can limit the accuracy of seed crystal positioning. This is of particular concern when precise orientation relationships are required in the cast article.

(4) Also with respect to ceramic molds, it is difficult to reuse seeds, since after shell removal and cutoff, the seeds must be sorted, cleaned, usually reinspected for grain orientation, and then repositioned within another cluster.

(5) The use of mold passages and apertures that are small relative to the size of the article cavity can present structural rigidity problems during pattern assembly. Ancillary members (e.g., ceramic tie bars) may be needed to support the pattern, which adds cost and weight to the assembly, and may under certain circumstances, compromise technical effectiveness during solidification, such as by altering heat flow characteristics or by inducing the undesirable nucleation of crystals at points of contact with the article cavity.

(6) Small mold passageways and apertures can also present difficulties during pattern removal (e.g., dewaxing). Pattern materials usually expand during heating (e.g., steam dewaxing or "burnout") and it is advantageous to have more than one relatively large mold opening. Although many molds can be dewaxed successfully through the top (via the metal feed), the presence of a large aperture at the bottom of the mold increases the speed and effectiveness of the operation, while minimizing the probability of shell damage.

(7) Small mold passageways and apertures can restrict the cross sectional area of metal which conducts heat to the chill plate. This limitation obviously can exist with small nonlinear passageways, and Erickson, et al. U.S. Pat. No. 3,724,531 teaches the use of a double-wall mold construction method to ameliorate that difficulty.

It will be obvious to those skilled in the art that many of these restrictions become more onerous when multiple cavity molds are involved or when more than one seed is used with an article cavity.

SUMMARY OF THE INVENTION

This invention relates to a method and means for producing articles having a predetermined crystalline orientation. The system of the invention is particularly concerned with the use of at least one seed crystal positioned in a mold cavity which defines the shape of the article to be formed. As already indicated, it is known that material, such as molten metal, may be introduced to the cavity in the area of the seed with the crystalline structure being formed beginning at the location of the seed crystal and then progressively throughout the mold cavity.

The invention is particularly concerned with the use of molds which are made by preparing a pattern and then applying a mold-forming material, such as layers of ceramic around the pattern. When using such techniques, the pattern material is typically discharged through a mold passage which is provided during the mold-making operation. For example, where the pattern is of wax, a passage is provided in the mold for removal of molten wax after the mold is formed around the pattern. As explained, this passage is preferably in addition to the metal feed passage at the top of the mold.

The particular improvement of the invention involves the step of forming a mold passage which is of large cross sectional dimension relative to a corresponding cross-sectional dimension of the seed crystal or crystals to be used in conjunction with the mold. A cradle having external wall surfaces dimensioned to mate with the interior wall surfaces of this mold passage is located in the mold passage. The seed crystal is mounted in the cradle, and the cradle is located in the passage in a manner such that the seed crystal is exposed within the mold cavity whereby the desired crystalline structure can be formed by introducing an article-forming material into the mold cavity.

The limitations discussed above under the heading "BACKGROUND OF THE INVENTION" can be reduced or eliminated through the use of a seed holder or cradle of the type described. Particularly where metal castings are involved, the cradle will comprise a preformed structural member, made of either ceramic or some relatively high melting point metal or alloy, which contains one or more internal cavities that contain one or more seeds. The seed or seeds can be accurately positioned relative to the external envelope of the cradle and with respect to each other, where applicable. The mold passage forms mating surfaces with the cradle, and thus orients the cradle and the one or more seeds which it contains relative to the article cavity.

In accordance with one embodiment of the invention, the cradle would be inserted after completion of shell fabrication. It should be understood, however, that it could be inserted immediately after pattern removal if the seed alloy were sufficiently refractory to withstand the mold firing cycle.

In accordance with another embodiment, the cradle takes the form of a cylinder or tube which is associated with the pattern prior to the mold making steps. After pattern removal, the cradle provides a precisely dimensioned mounting means for a crystal or crystals.

BRIEF DESCRIPTION OF THE DRAWINGS

FIG. 1 is an elevational view of a pattern of the type typically used for the preparation of molds to be used for the casting of a turbine blade;

FIG. 2 is a vertical, cross-sectional view of a ceramic mold produced utilizing a pattern of the type shown in FIG. 1;

FIG. 3 is a vertical, elevational view of pattern, partly cut away, modified in accordance with one form of this invention;

FIG. 4 is a vertical, sectional view illustrating a ceramic mold modified in accordance with another form of this invention;

FIG. 5 is a vertical, sectional view illustrating still another modification in accordance with this invention;

FIGS. 6A—6D comprise perspective views illustrating alternative forms of cradles and seed crystal configurations;

FIG. 7 is a perspective view of a modified cradle and seed crystal assembly;

FIG. 8 is a vertical, sectional view taken about the line 8—8 of FIG. 7;

FIG. 9 is a horizontal, sectional view taken about the line 9—9 of FIG. 7;

FIG. 10 is a top view of a modified form of the cradle and seed crystal;

FIG. 11 is a top view of another modified form of the cradle and seed crystal; and, FIG. 12 is a vertical, sectional view illustrating still another modification in accordance with this invention.

DETAILED DESCRIPTION OF THE INVENTION

FIGS. 1 and 2 illustrate typical prior art pattern and mold structures. The pattern 10 shown in FIG. 1 may be formed of wax and utilized in the production of a turbine blade. This pattern includes an extension 12 at the top which is typically provided for forming a metal feed passage in a mold. Another extension 14 at the bottom of the pattern is provided to form a passage in the mold which will ultimately be employed for removal of the pattern material after the mold has been formed.

FIG. 2 illustrates a mold 16 which may be formed by any conventional means. For example, the mold 16 can be produced by repeatedly dipping a pattern 10 into a ceramic slurry to build up layers of ceramic around the pattern. After firing, a mold having a metal feed passage 18, a lower passage 20, and an intermediate article forming cavity 22 will result. The passage 20 is particularly useful as a means for permitting removal of the pattern material, for example, where the material comprises wax or some other substance which can be brought to a molten state and allowed to flow out of the mold.

In order to provide a suitable means for removing pattern material, the passage 20 should have relatively large dimensions so that the pattern material will flow freely out of the mold. As previously indicated, however, this creates problems when the mold is to be used in conjunction with a seed crystal which must be accurately positioned relative to the mold cavity and which is preferably of relatively small diameter. The arrangement shown in the subsequent figures illustrates means for avoiding these problems and limitations.

FIG. 3 illustrates one embodiment of the invention wherein a cylinder or tube 24 is associated with a pattern 10. This cylinder may be made of a ceramic material or a high melting point metal, and it is held in a fixed position relative to other pattern portions. Additional wax or other material 26 may be utilized to position the cylinder 24 relative to the support upon which the pattern is mounted to insure that the cylinder is fixed relative to the remainder of the pattern.

A ceramic or metal stiffener 28 extends into the pattern 10 to provide additional rigidity during the pattern assembly and handling operations. The stiffener is usable as an option particularly where the diameter of the cylinder 24 is small relative to the size of the pattern 10.

After formation of the mold 16 around the pattern, the pattern material is removable through the feed passage 18 and also through the passage 30 defined by the interior of the cylinder 24. Where a stiffener 28 is employed, the stiffener will be automatically removed from the mold cavity along with the pattern material. The resulting assembly is shown in FIG. 4.

The assembly of FIG. 4 provides a mold with the cylinder 24 comprising a cradle for a seed crystal as contemplated by this invention. It will be appreciated that the ceramic or metal cylinder 24 can be preformed with high precision to a desired cross section. Accordingly, a seed crystal can be readily located in the passage 30, and by controlling the dimensions of the seed crystal with equal precision, an uncomplicated assembly operation is possible.

Although the cradle of FIG. 4 has been described as a "cylinder" 24, no limitation on the crosssectional shape of this member is intended. Various shapes are possible (and even desirable in some cases) as described, for example with reference to FIGS. 6A through 6D and 10.

As explained, it is often desirable that the seed crystal be oriented relative to the mold cavity in both longitudinal and transverse respects. Since the orientation of the crystal can be determined before it is associated with the cavity, it is desirable to provide means for controlling this orientation when the seed crystal is inserted into the cradle comprising the cylinder 24.

FIG. 11 illustrates a means for controlling this orientation wherein the seed crystal 32 is provided with a flat face 34. This face is dimensioned to correspond with a face of the cylinder 24 so that the seed crystal will always have a precise relationship with the cylinder 24. During pattern assembly, a worker need only orient the cylinder 24 properly relative to the pattern, and this will automatically result in proper orientation of the seed crystal with respect to the mold.

FIG. 5 illustrates a modified form of the invention wherein a cradle 36 carrying a seed crystal 38 is associated with mold 16. In this instance, the cradle 36 is dimensioned to correspond with the dimensions of passage 40 formed during mold making. Thus, the cradle 36 is not associated with the mold until after the pattern material has been completely removed. At that point, the cradle is inserted.

In the embodiment of FIG. 5, the pattern portion designed to form passage 40 is precisely dimensioned to provide cross sectional dimensions corresponding with the external dimensions of the cradle. This cradle can be readily manufactured with precision so as to mate precisely with the interior dimensions of the passage 40. The assembly of the seed crystal 38 with the cradle take place independently of the mold making operations, and this greatly simplifies the location of the seed crystal relative to the mold cavity.

The embodiments of the invention described also greatly simplify pattern removal operations since the mold passages which receive the cradles provide available avenues for removal of pattern material. This is particularly true with respect to the embodiment of FIG. 5 since the diameter of passage 40 can be large even where the seed crystal 38 is of very small diameter.

The embodiment of FIG. 5 can also be designed to provide automatic orientation of the seed crystal relative to the mold cavity. As shown in FIG. 10, the cradle 36 may have a flat 42 on one side and a corresponding flat can be formed in the pattern portion prior to mold formation. The result will be that the cradle 36 can only be inserted in the mold in one position, and workers can thereby control seed orientation by locating the seed 38 in a precise position relative to the cradle. Orientation of the seed relative to the cradle can be achieved automatically by producing seeds and cradles with flats as shown at 44, and as discussed with reference to FIG. 11.

An additional or alternative means for achieving orientation may involve the use of indicia such as arrows 46 formed on a seed and/or 48 formed on a cradle. The indicia could be lined up with each other, or with indicia such as ridges or grooves formed in a mold thereby providing visual means for an operator for achieving orientation. It will be appreciated that other means for achieving orientation are possible including the use of other indicia or the use of notches and grooves.

The geometry of the seed cradles and/or seeds is subject to wide variations. FIGS. 6A through 6D illustrate cradles 50, 52, 54 and 56, respectively, illustrating forms that may be assumed by cradles. It will be particularly noted with respect to FIGS. 6C and 6D, that the cradles may contain a plurality of seed crystals 58 for achieving multiple locations for initiating crystal growth within a mold.

As shown in FIGS. 5 and 8, seed crystals 38 and 60 may have a length in excess of the bore length of the respective cradles. Such a seed crystal protrusion will increase the choice of casting parameters which will result in controlled seed melt back and subsequent epitaxial growth. The parameters chosen must avoid the formation of undesirable equiaxed grains such as by "chilling" on the seed surface.

It is also contemplated, however, that the seed crystal will terminate short of the juncture between the cradle passage and mold cavity. With the exposed end of the seed crystal located short of this juncture, the article forming material will enter the passage for contact with the exposed end to begin the article formation.

Under normal circumstances, the surface of the cradle that communicates with the article cavity (the "tip"), would define a plane parallel to the chill plate. This configuration facilitates the reuse of seeds and seed cradles, in that they can be easily cut off after casting and simply reinserted into another mold. However, it may be advantageous in certain circumstances to taper the tip surface of the cradle so as to match the slope of, and essentially create an extension to, the adjacent ramped portion of the internal surface of the mold cavity. This is illustrated by the tapered surfaces 62 shown in FIG. 5 which match the slope of the adjacent mold surfaces 64. This geometry can facilitate simultaneous longitudinal and transverse growth of a single crystal into the mold cavity.

FIGS. 7 through 9 illustrate another alternative construction wherein seed cradles 66 formed of ceramic material are provided with internal cavities. These cavities are filled with a material of higher heat conductivity such as sodium or copper metal. It will be appreciated that in the formation of single crystals, it is desirable to withdraw heat longitudinally by means of a chill plate 70 of the type shown in FIG. 5. The arrangement shown in FIGS. 7 through 9 will tend to increase the longitudinal temperature gradient and will also favorably influence the solidification rate. It will be appreciated that other means may be employed for constructing the cradles to provide a "heat" pipe construction and to thereby improve the solidification conditions.

In the modification of the invention shown in FIG. 12, there is illustrated a mold 70 with the longitudinal axis of the mold cavity 72 formed at an angle to the vertical and thus tilted relative to chill plate 78. The seed cradle 74 and seed 76 are oriented with their longitudinal axes parallel to the longitudinal axis of the mold cavity 72.

The arrangement shown can be useful in improving the soundness of directionally solidified castings while maintaining the advantages associated with the use of a seed crystal contained in a seed cradle. More specifically, under normal circumstances, the "longitudinal" axis of the part will lie substantially perpendicular to the chill plate (or other means of heat extraction) and thus be parallel to the direction of heat withdrawal. In the case of face-centered cubic metal solidification using an <001> seed, for example, the resulting <001> crystal will grow parallel to the longitudinal axis of the part.

The arrangement of FIG. 12 contemplates situations where the longitudinal axes of the mold cavity, cradle, and seed will lie at angles other than 90° relative to the chill plate. Acute angles of inclination, for example, up to about 15° (from the perpendicular), can be an effective way to improve the soundness of cast articles, particularly in "corners" or otherwise "blind" horizontal surfaces, such as in the platforms of gas turbine engines blades and vanes, by permitting the access of "feed metal" during solidification. It should be noted that in this kind of situation, the orientation of the cradle need not be parallel to the longitudinal axis of the "tilted" article, and/or it may be desirble to select a seed crystal of slightly different orientation, in order to "compensate" for the tilting of the article cavity.

Also contemplated is the use of acute or obtuse angles of inclination, for example, up to about 75°, in order to achieve crystalline orientations in the article which are different than those of the seed. For example, a cradle containing an <001< seed (with a proper secondary orientation) could be used to produce an article exhibiting a <111> orientation (relative to its longitudinal axis) by tilting the mold cavity by about 54.7° to the chill plate.

The various cradles described may also be used in association with another cradle, for example of the type shown in FIG. 4. Thus, the cylinder 24 may define an opening which corresponds dimensionally with the external dimensions of a cradle holding one or more seed crystals. The latter cradle can then be positioned within cylinder 24 at any appropriate time prior to introduction of molding material into a mold cavity.

As set forth above and in the various prior art references discussed herein, the present invention is particularly suitable for the casting of metals particularly metals of the superalloy type typically used for the production of turbine blades and vanes. The invention is, however, also applicable to other structural transformations such as directional recrystallization and solid-tosolid phase changes.

More specifically, it is contemplated that crystalline or non-crystalline powder, flake, or other solid material, be placed in the mold cavity. Such material, preferably having at least one dimension of less than about 0.010 inches, can be consolidated using techniques such as hot isostatic pressure, dynamic compaction, or sintering, and can then be directionally recrystallized or solid state transformed within the mold cavity.

The material for forming the cradles may be selected from ceramic materials of the type used in this art, e.g., alumina or zirconia. The seed crystal composition is, of course, dependent on the composition of the article to be formed in a mold although duplication is not required. For example, use of a "universal" seed crystal material (such as pure nickel for all nickel-base alloys) is contemplated.

It will further be understood that changes and modifications may be made in the above-described system which provide the characteristics of the invention without departing from the spirit of the invention as set forth in the following claims.

We claim:

1. In a method for the production of an article having a predetermined crystalline orientation wherein at least one seed crystal is positioned in a mold defining a cavity having the shape of the article to be formed, and wherein material for forming the article is introduced to the mold cavity, the seed crystal being located for exposure to the forming material initially introduced whereby the crystalline structure is formed beginning at the location of the seed crystal and then progressively throughout the mold cavity, the mold being of the type made by the process of preparing a pattern, applying mold material around the pattern, and thereafter removing the pattern, the improvement comprising a method for locating the seed crystal comprising the steps of including in said pattern a portion of large cross-sectional dimension relative to the cross-sectional dimension of the seed crystal, said pattern portion comprising an extension of the section of the pattern employed for forming the mold cavity whereby a passage leading to the mold cavity is formed after removal of the pattern, providing a cradle in said passage, said cradle having external wall surfaces dimensioned to mate with the interior wall surfaces of said passage, said seed crystal being mounted in said cradle, whereby said seed crystal is exposed to the article forming material introduced to said mold cavity for formation of said crystalline structure.

2. A method in accordance with claim 1 wherein the material forming the pattern is at least partially removed through said passage.

3. A method in accordance with claim 1 including the step of associating said cradle with said pattern, forming said mold around the exterior surface of the cradle whereby the cradle remains associated with the mold after pattern removal, and locating said seed crystal in the cradle after pattern removal.

4. A method in accordance with claim 3 wherein said cradle comprises a ceramic member defining an interior passage, the exterior surfaces of said seed crystal mating with the interior surfaces of said cradle.

5. A method in accordance with claim 1 including the step of locating said cradle in said passage subsequent to removal of the material forming the pattern from said mold cavity, said seed crystal being mounted in said cradle prior to-locating of the cradle in said passage.

6. A method in accordance with claim 5 wherein said mold comprises a ceramic mold requiring a firing step subsequent to pattern removal, said cradle being inserted after said firing step.

7. A method in accordance with claim 1 including the step of orienting the seed crystal relative to the mold cavity for controlling longitudinal and transverse crystalline orientation in the article to be formed.

8. A method for the production of an article having a predetermined crystalline orientation, wherein at least one seed crystal is positioned in a mold defining a cavity having the shape of the article to be formed, and wherein material for forming the article is introduced to the mold cavity, the seed crystal being located for exposure to the forming material initially introduced whereby the crystalline structure is formed beginning at the location of the seed crystal and then progressively throughout the mold cavity, the mold being of the type made by the process of preparing a pattern, applying mold material around the pattern, and thereafter removing the pattern, the improvement comprising the steps of including in said pattern a portion of large cross-sectional dimension relative to the cross-sectional dimension of the seed crystal, said pattern portion comprising an extension of the section of the pattern employed for forming the mold cavity, applying said mold material around the pattern and then removing the pattern thereby forming the mold cavity and also forming a passage leading to said mold cavity in the area previously occupied by said pattern portion, and inserting a cradle in said passage, said cradle having external wall surfaces dimensioned to mate with the interior wall surfaces of said passage, said seed crystal being inserted in said cradle, whereby said seed crystal is exposed to the article forming material introduced to said mold cavity for formation of said crystalline structure.

9. A method for the production of an article having a predetermined crystalline orientation wherein at least one seed crystal is positioned in a mold defining a cavity having the shape of the article to be formed, and wherein material for forming the article is introduced to the mold cavity, the seed crystal being located for exposure to the forming material initially introduced whereby the crystalline structure is formed beginning at the location of the seed crystal and then progressively through the mold cavity, the mold being of the type made by the process of preparing a pattern, applying mold material around the pattern, and thereafter removing the pattern, the improvement comprising the steps of associating an open-ended preformed cradle with said pattern, said cradle creating an extension of the section of the pattern employed for forming the mold cavity, a passage defined by said cradle, forming said mold cavity by applying said mold material around said pattern and then removing the pattern, and inserting a seed crystal in the passage defined by the cradle, whereby said seed crystal is exposed to the article forming material introduced to said mold cavity for formation of said crystalline structure.

10. A method for the production of an article having a predetermined crystalline orientation wherein at least one seed crystal is positioned in a mold defining a cavity having the shape of the article to be formed, and wherein material for forming the article is introduced to the mold cavity, the seed crystal being located for exposure to the forming material initially introduced whereby the crystalline structure is formed beginning at the location of the seed crystal and then progressively through the mold cavity, the mold being of the type made by the process of preparing a pattern, applying mold material around the pattern, and thereafter removing the pattern, the improvement comprising the steps of associating an open-ended preformed cradle with said pattern, said cradle creating an extension of the section of the pattern employed for forming the mold cavity, a passage defined by said cradle, forming said mold cavity by applying said mold material around said pattern and then removing the pattern, providing a second cradle, said seed crystal being inserted in said second cradle, and inserting said second cradle in said passage, whereby said seed crystal is exposed to the article forming material introduced to said mold cavity for formation of said crystalline structure.

11. A method in accordance with claims 8, 9 or 10 including the step of orienting seed crystals relative to the mold cavity for controlling the longitudinal, transverse, or longitudinal and transverse crystalline orientation of the articles to be formed.

12. A method in accordance with claim 8 wherein said mold comprises a ceramic mold requiring a firing step subsequent to pattern removal, said cradle being inserted in said passage after said firing step.

13. A method in accordance with claims 8 or 10 wherein the pattern material forming the mold cavity is at least partially removed through said passage.

14. A method in accordance with claim 8 wherein said seed crystal is placed in said cradle prior to inserting said cradle in said passage.

15. A method in accordance with claim 10 wherein said seed crystal is placed in said second cradle prior to inserting said second cradle in said passage.

16. A method in accordance with claim 9 or 10 wherein said pattern material is located in said passage, and wherein said pattern material is removed from said passage after formation of said mold.

17. A method in accordance with claims 8 or 9 wherein said cradle is made of a material selected from ceramic materials and high melting point metals and alloys.

18. A method in accordance with claims 9 or 10, wherein said passage receives at least one ceramic or metal stiffener extending into the pattern to provide additional rigidity during pattern assembly and handling operations, and wherein said stiffener is removed from the mold cavity and passage during pattern removal.

19. A method in accordance with claims 8,9 or 10 including the step of orienting the seed crystal relative to the mold cavity for controlling longitudinal and transverse crystalline orientation in the article to be formed, said cradle or said second cradle is positioned in said passage using visual or geometric indicia such as marks, ridges, or grooves.

20. A method in accordance with claims 8, 9 or 10 wherein said article is formed by solidification and is a single crystal.

21. A method in accordance with claims 8, 9 or 10 wherein said article is formed by solidification and is a columnar grained structure.

22. A method in accordance with claims 8, 9 or 10 wherein said article is formed by placing a plurality of pieces of solid material having at least one dimension of less than about 0.010" in said mold cavity, consolidating said solid material, and directionally recrystallizing said solid material.

23. A method in accordance with claims 8, 9 or 10 wherein said article is formed by placing a plurality of pieces of solid material having at least one dimension of less than about 0.010" in said mold cavity, consolidating said solid material, and solid-state transforming said solid material.

24. A method in accordance with claim 22 wherein said article is a columnar-grained structure.

25. A method in accordance with claim 23 wherein said article is a columnar-grained structure.

26. A method in accordance with claim 20 wherein said article comprises an engine component resistant to operation at high temperatures and formed from a member selected from the group consisting of nickel, cobalt and iron-based alloys.

27. A method in accordance with claim 21 wherein said article comprises an engine component resistant to operation at high temperatures and formed from a member selected from the group consisting of nickel, cobalt and iron-based alloys.

28. A method in accordance with claim 22 wherein said article comprises an engine component resistant to operation at high temperatures and formed from a member selected from the group consisting of nickel, cobalt and iron-based alloys.

29. A method in accordance with claims 1, 8 or 9 wherein a plurality of seed crystals are associated with the cradle for exposure to the article forming material.

30. A method in accordance with claims 1, 8, 9 or 10 wherein the exposed end of the seed crystal is located within said passage whereby said article forming material enters the passage for contact with said exposed end.

31. A method in accordance with claims 1, 8, 9 or 10 comprising the steps of locating the mold on a chill surface, and positioning the axis of said mold at an angle relative to a line extending vertically away from the chill surface whereby the mold is tilted relative to the chill surface.

32. A method in accordance with claim 31 wherein the longitudinal axis of the cradle with associated seed crystal is substantially parallel with said longitudinal axis for said mold.

33. A method in accordance with claim 10 wherein said mold comprises a ceramic mold requiring a firing step subsequent to pattern removal, said second cradle being inserted in said passage after said firing step.

34. A method in accordance with claim 10 wherein said cradles are made of a material selected from ceramic materials and high melting point metals and alloys.

35. A method in accordance with claim 10 wherein a plurality of seed crystals are associated with the second cradle for exposure to the article forming material.

36. In a mold for use in the production of an article having a predetermined crystalline orientation wherein at least one seed crystal is positioned in the mold, the mold defining a cavity having the shape of the article to be formed, and wherein material for forming the article is introduced to the mold cavity, the seed crystal being located for exposure to the forming material initially introduced whereby the crystalline structure is formed beginning at the location of the seed crystal and then progressively throughout the mold cavity, the mold being of the type made by the process of preparing a pattern, applying mold material around the pattern, and thereafter removing the pattern, the improvement in means for locating the seed crystal relative to said mold, said means comprising a passage defined in proximity to said mold cavity, said passage having a large cross-sectional dimension relative to the cross-sectional dimension of the seed crystal, said passage comprising an extension of the mold cavity, and a cradle positioned in said passage, said cradle having external wall surfaces dimensioned to mate with the interior wall surfaces of said passage, said seed crystal being mounted in said cradle whereby said seed crystal is exposed within said mold cavity for formation of said crystalline structure.

37. A mold in accordance with claim 36 wherein said passage is of large enough dimension so that material forming the pattern can be at least partially removed through said passage.

38. A mold in accordance with claim 36 wherein said cradle comprises a ceramic member defining an interior passage, the exterior surfaces of said seed crystal mating with the interior surfaces of said cradle.

39. A mold in accordance with claim 36 including means for orienting the seed crystal relative to the mold cavity for controlling longitudinal and transverse crystalline orientation in the article to be formed.

40. A mold in accordance with claim 36 wherein mating flats are defined by at least one of the pairs comprising the seed crystal and the cradle, and the cradle and the mold passage, to provide said means for orienting the seed crystal relative to the mold cavity.

41. A mold in accordance with claim 39 wherein indicia are defined by at least one of the seed crystal, cradle and mold to provide said means for orienting the seed crystal relative to the mold cavity.

42. A mold in accordance with claim 36 defining surface porions extending angularly upwardly away from said passage, the surfaces of said seed crystal exposed within said mold cavity having a slope corresponding with the slope of said mold surfaces.

43. A mold in accordance with claim 36 wherein said seed crystal protrudes beyond the cradle within said mold cavity.

44. A mold in accordance with claim 36 wherein the exposed end of the seed crystal extends short of the juncture of said passage and said mold cavity.

45. A mold in accordance with claim 36 comprising a ceramic mold requiring a firing step subsequent to pattern removal.

46. A mold in accordance with claim 36 wherein said seed crystal is placed in a first cradle, and including a second cradle, said passage being defined by said second cradle with said first cradle and associated seed crystal being thereby received within said second cradle.

47. A mold in accordance with claim 46 wherein said cradles are made of a material selected from ceramic materials and high melting point metals and alloys.

48. A mold in accordance with claims 36 or 46 wherein said passage received at least one ceramic or metal stiffener extending into the pattern to provide additional rigidity during pattern assembly and handling operations, and wherein said stiffener is removed from the mold cavity and passage during pattern removal.

49. A mold in accordance with claim 36 wherein a plurality of seed crystals are associated with the cradle for exposure to the article forming material.

50. A mold in accordance with claim 36 including a chill surface supporting the mold, the longitudinal axis of said mold being positioned at an angle relative to a line extending vertically away from the chill surface whereby the mold is tilted relative to the chill surface.

51. A mold in accordance with claim 50 wherein the longitudinal axis of said cradle and associated seed crystal is positioned substantially parallel with said longitudinal axis of said mold.

52. A mold in accordance with claim 36 wherein said cradle is made of a material selected from ceramic materials and high melting point metals and alloys.

* * * * *